343-756. SR
2-10-76 OR 3,938,159

United States Patent [19]
Ajioka et al.

[11] 3,938,159
[45] Feb. 10, 1976

[54] DUAL FREQUENCY FEED HORN USING NOTCHED FINS FOR PHASE AND AMPLITUDE CONTROL

[75] Inventors: James S. Ajioka, Fullerton; Kenneth L. Schaffer, Diamond Bar, both of Calif.

[73] Assignee: Hughes Aircraft Company, Culver City, Calif.

[22] Filed: Sept. 17, 1974

[21] Appl. No.: 506,830

[52] U.S. Cl. ..... 343/756; 343/786
[51] Int. Cl.[2] ..... H01Q 13/02; H01Q 15/24
[58] Field of Search ..... 343/753, 755, 773, 783, 343/785, 786, 909

[56] References Cited

UNITED STATES PATENTS

| | | | |
|---|---|---|---|
| 2,317,464 | 4/1943 | Katzin | 343/786 |
| 3,013,267 | 12/1961 | Rotman | 343/783 |
| 3,055,004 | 9/1962 | Cutler | 343/786 |
| 3,100,894 | 8/1963 | Giller et al. | 343/786 |
| 3,656,166 | 4/1972 | Klopach | 343/773 |
| 3,754,273 | 8/1973 | Takeichi et al. | 343/786 |

*Primary Examiner*—Eli Lieberman
*Attorney, Agent, or Firm*—W. H. MacAllister; Robert H. Himes

[57] ABSTRACT

A dual frequency band horn-type antenna feed is described which has primary application to optimally illuminate a parabolic cylindrical reflector operating simultaneously at high power in both of the two bands. The principle of the invention is applicable to any two frequency bands regardless of their frequency separation including coincidence as a limiting case. The basic requirement of such a feed is that it must be as directive as possible within constraint of the feed aperture size in the plane of the cylinder axis because the cylindrical reflector does not collimate the beam in this plane and it must be relatively nondirective in the plane of the parabola for efficient illumination of the reflector. This requirement requires the phase front in the directive plane to be controlled within a small fraction of a wavelength at both frequencies.

7 Claims, 15 Drawing Figures

DUAL FREQUENCY FEED HORN USING NOTCHED FINS FOR PHASE AND AMPLITUDE CONTROL

BACKGROUND OF THE INVENTION

One method recently employed to provide antennas for two frequency bands was to mount the two antennas back-to-back. This arrangement has the disadvantage of increasing the weight of the combination antenna thus requiring a heavier pedestal with its associated more powerful drive system. Also additional weight is sometimes very objectionable if, for example, the back-to-back antennas were to be placed aboard ship. Lastly, back-to-back antennas must necessarily be used in a rotating mode since the individual antennas cannot cover the same area simultaneously. A dual frequency band horn-type feed uses a common cylindrical paraboloid reflector thus minimizing the weight increase and covering the same area.

SUMMARY OF THE INVENTION

In accordance with the present invention, a single feed horn is excited with two orthogonally polarized signals from a higher and a lower frequency band by means of a transducer from coaxial line or waveguide. A series of conductive notched fin pairs are placed within the feed horn in the parabolic plane of the reflector. The depth and spacing of the notches control the phase velocity of the wave in the region between the notched fin pairs. If the notches are less than a quarter wavelength, they act as a series inductance to slow the wave down. That is, the degree by which the wave is slowed down increases with effective notch depth within the range of notch depth of zero to $\lambda/4$. The notch spacing is such that there are several per free space wavelength. Generally, the larger the number of notches per wavelength, the slower the phase velocity. These parameters (slot depth and spacing) are used to control the phase velocity of the wave and also to effect a good impedance match at the input of the finned region and at the output to free space. The phase front at the aperture can be controlled by the phase velocity and/or the length of the notched region thus allowing great versatility in design. The effective aperture for the low frequency signal is the entire horn and is polarized normal to the fins and parallel to the cylinder axis of the reflector. The effective aperture for the high frequency signal is the space between the fin pairs and is polarized in the plane of the fins and orthogonal to the polarity of the low frequency signal. The effective apertures for both the high and the low frequencies in the plane of the fins must be the same in terms of wavelength for optimum illumination of the reflector for both frequencies. Also, the phase centers must be coincident and coincide with the focal point of the cylindrical parabolic reflector.

DESCRIPTION

Figure 1:
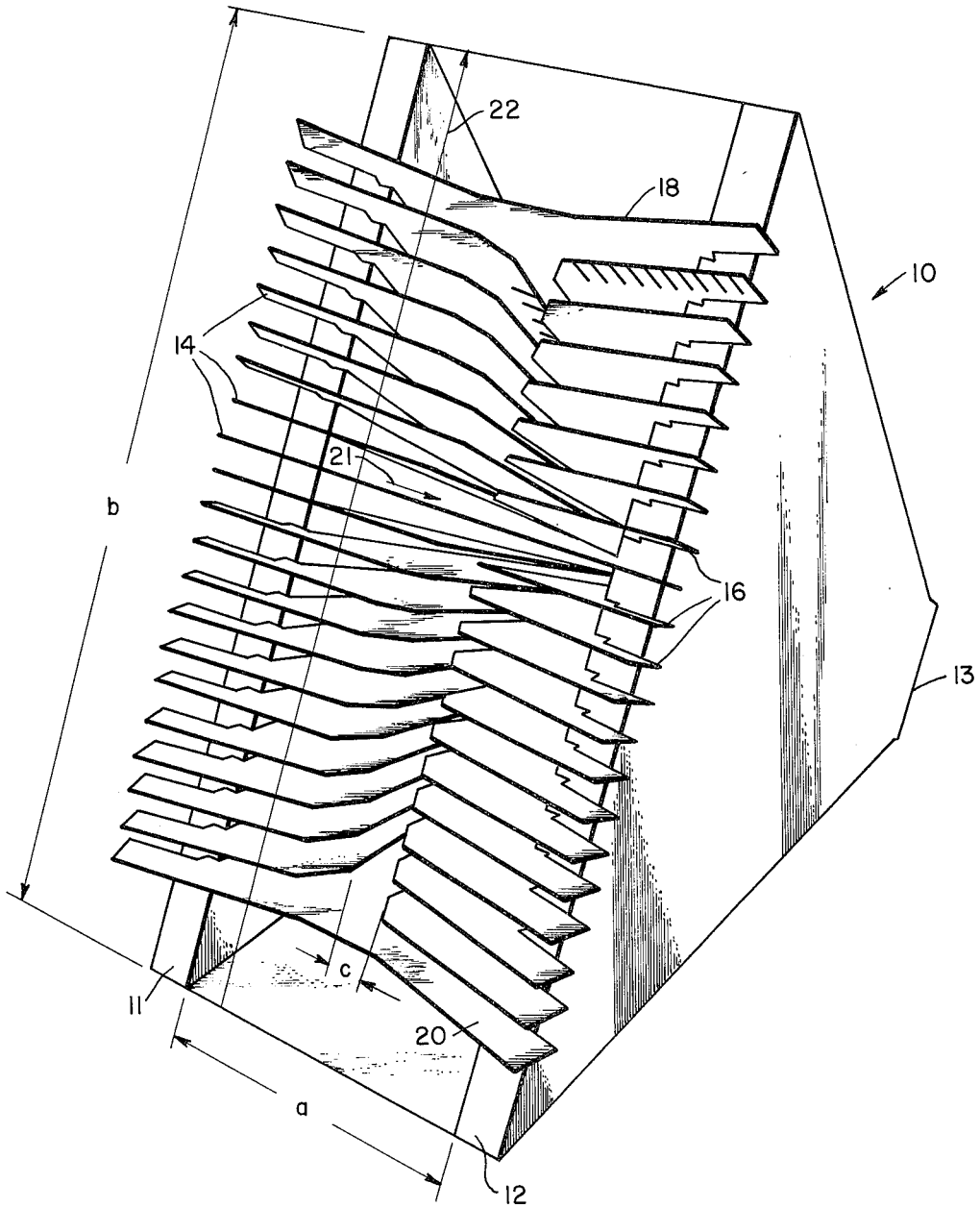
FIG. 1 illustrates a front view of the feed horn of the present invention in perspective.

Referring now to FIG. 1 of the drawings, there is shown a front perspective view of the dual frequency band feed horn of the present invention. In particular, the feed horn comprises a conductive rectangular horn 10 having a rectangular aperture of width *a* and height *b* with flanges 11, 12 extending outwards from the longest sides and an input flange 13 extending outwards from smaller extremity. In accordance with the invention, a plurality of pairs of notched fins 14, 16 are disposed along the *b* dimension of the horn 10 extending from the input to the aperture thereof and wrapping around flanges 11, 12 with a substantially uniform gap *c* therebetween. Fins 14, 16 are notched along internal edges for phase control purposes and across the aperture for shaping the beam. Notched fins 18, 20 extend completely across the *a* dimension of the aperture inside the horn 10 at opposite sides of the fins 14, 16 and wrap around the flanges 11, 12 in the same manner as the fins 14, 16. Fins 18, 20 are only notched across the aperture with beam shaping notchings. In operation, the E-Field of the high frequency band is excited through the flange 13 of horn 10 across the gap *a* between fins 14, 16 as indicated by arrow 21 and the E-Field of the low frequency band is excited along the entire *b* dimension of the aperture as indicated by arrow 22.

Figure 2:
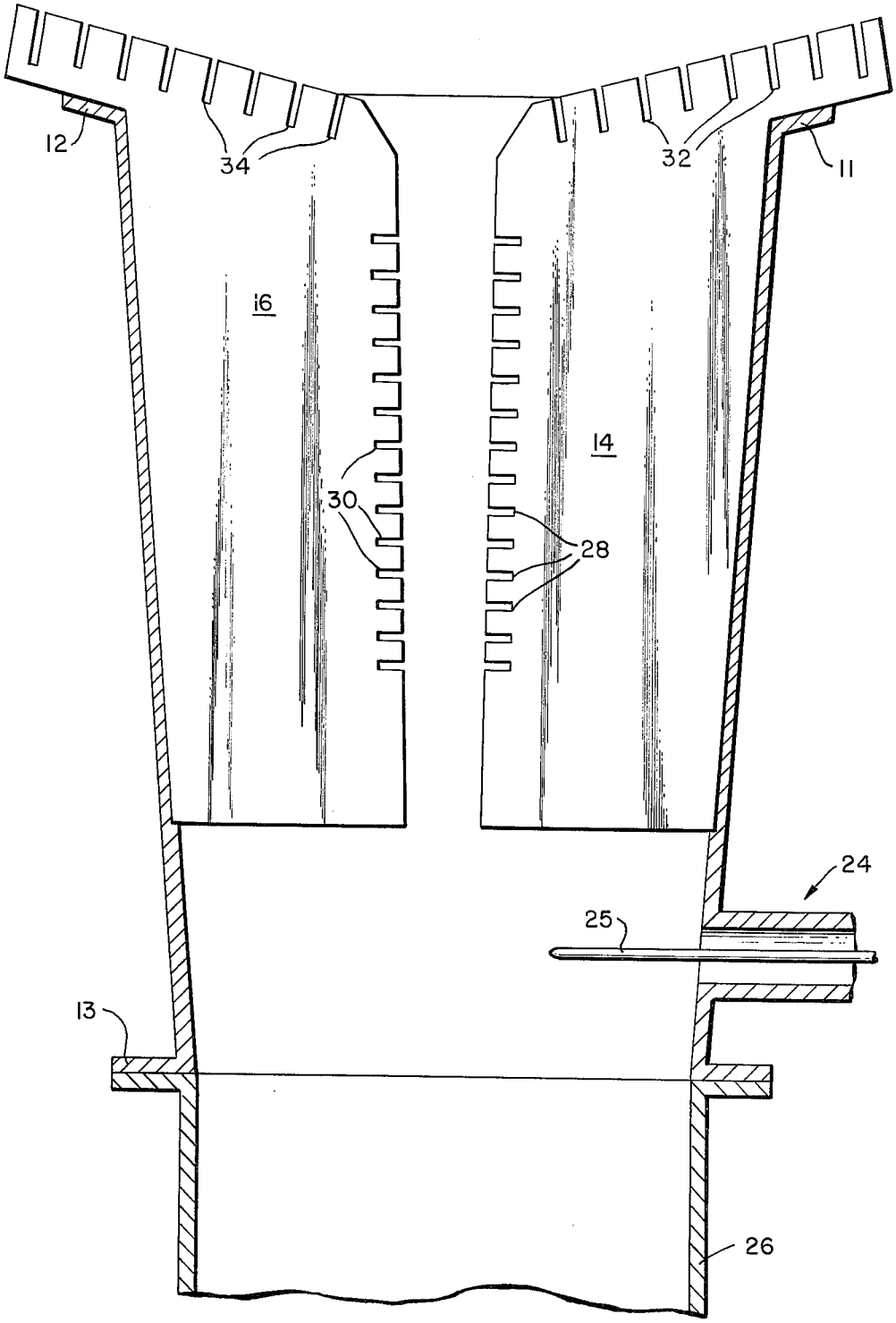
FIG. 2 shows a cross-sectional view of the feed horn of FIG. 1 in the plane of the parabolic reflector, not shown.

Referring to FIG. 2 of the drawings, there is shown a cross-sectional view of the horn 10 in the plane of the parabolic reflector, not shown. The high frequency E-Field may be excited in horn 10 by means of a coaxial input having a center conductor 25 which extends into the horn 10 in back of the notched fins 14, 16 and is oriented to excite the E-Field across the gap *c* therebetween. The low frequency E-Field, on the other hand, may be introduced into the horn 10 by means of a rectangular waveguide 26 connecting the flange 13 of horn 10 with a broad side thereof in a plan view, as shown in the drawing. Thus, a signal in a $TE_{1,0}$ mode propagating through waveguide 26 will excite a low frequency E-Field of a vector 22 across the aperture of horn 10. Along the opposite edges of the fins 14, 16 there is disposed a series of periodically spaced notches 28, 30, respectively, for controlling the phase of the high frequency E-Field at the aperture of the horn 10. In addition, the front edges of the fins 14, 16 include periodically spaced notches 32, 34, respectively, for shaping the high frequency beam. In general, the notches 28, 30, 32, 34 are made a nominal one-quarter wavelength deep with deviations therefrom to either add inductance or capacitance as required by the circumstances i.e. to speed up or slow down the wave bounded by the fins.

The dual frequency band feed of FIGS. 1 and 2 has primary application to optimally illuminate a parabolic cylindrical reflector, not shown, operating simultaneously in two frequency bands, both at high radio frequency power. Although the device of the present invention is applicable to any two frequency bands regardless of their frequency separation including coincidence as a limiting case, the embodiment of FIGS. 1 and 2 was designed to operate in the 1 $GH_z$ and 6 $GH_z$ frequency bands. The basic requirement of such a feed is that it must be as directive as possible within constraint of the feed aperture size in the plane of the parabolic cylinder axis because the cylindrical reflector does not collimate the beam in this plane and it must be relatively nondirective in the plane of the parabola for efficient illumination of the reflector. This requires that the phase front in the directive plane, i.e. the plane of the cylindrical axis, to be controlled within a small fraction of a wavelength at both frequencies.

Referring to FIG. 1 wherein an aperture view of the feed is shown, the effective aperture for the lower frequency is the entire horn and is polarized as shown by the field intensity vector 22. The effective aperture for the higher frequencies is the space *c* between the fin pairs 14, 16 and is polarized as shown by the field intensity vector 21 which is orthogonal to the field intensity vector 22. The high and low frequency signals are launched in the feed by the coaxial probe 25, and by a $TE_{1,0}$ input through rectangular waveguide 26, respectively. For optimum illumination of the reflector for both the high and low frequencies, the effective apertures for both frequencies in the parabolic plane of the reflector is made the same in terms of wavelengths at the respective frequencies. Also, the phase centers are both made to coincide with the focal point of the parabolic reflector.

In the plane orthogonal to the fins 14, 16 the two frequencies share the entire aperture. It is in this plane that the phase and amplitude distributions must be accurately controlled to shape the radiation pattern in this plane. Since this is not the parabolic plane of the reflector, the reflector plays no role in beam collimation. For the operation at the lower frequency in the configuration of FIG. 1, the notched fins 14, 16 have no function and are "invisible" to the low frequency because they are normal to the electric (E) field vector 22 of the low frequency energy. Hence, the radiation pattern from the horn at the low frequency is essentially the same as an identical horn with no fins.

For the higher frequency, however, the fins 14, 16 play a vital role. The spacing between the fins 14 and between the fins 16 is made sufficiently close, i.e. very much less than one half wavelength at the higher frequency, so that the high frequency field essentially does not penetrate into the space between adjacent fins 14 or 16; thus the effective aperture for the high frequency energy is reduced to the space *c* shown in FIG. 1. This reduction in effective aperture makes the aperture in the parabolic plane equal, in terms of wavelengths, to that of the low frequency, as desired.

The interior notches 28, 30 of the fins 14, 16, respectively, control the phase velocity of that portion of the power traveling between fin-pairs. The total phase from the throat of the horn to the horn aperture of the power between fin-pairs is determined by the depth, width, spacing and length of the notched region along the fins 14, 16 interior to the horn. By varying these parameters from fin-pairs to fin pair, i.e. notch, depth, width, spacing, length of notched region of fin 14 or 16, spacing between fin-pairs, precise phase control can be achieved over the large dimension of the horn aperture. By non-uniform spacing of the fins 14, 16 at the throat of the horn as compared to the spacing at the horn aperture, some degree of amplitude control is achieved at the horn aperture. Thus, both aperture amplitude and phase control is achieved at the horn aperture for the high frequency energy whereby the radiation beam shape in the plane of the cylindrical axis is achieved.

Figure 3A:
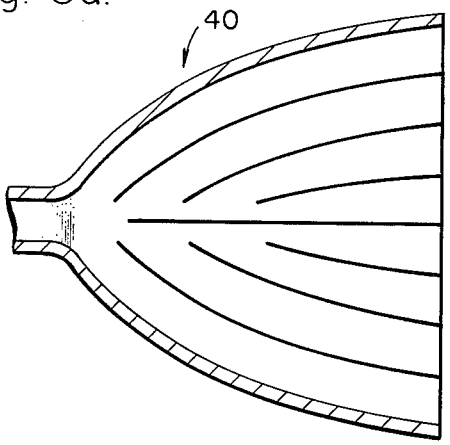
FIGS. 3*a*, 3*b* and 3*c* show a feed horn in accordance with the present invention incorporating non-parallel notched fins.
Figure 3B:
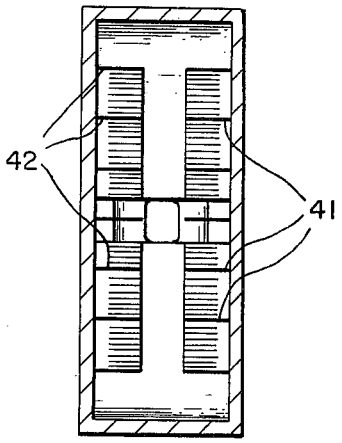
Figure 3C:
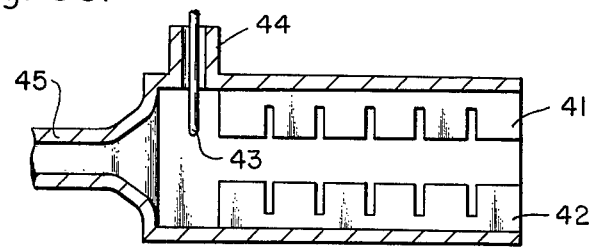

Referring to FIG. 3 there is shown the application of notched fins in finned parallel plate microwave devices such as a parallel plate horn 40. Parallel plate horn 40 incorporates notched fins 41, 42 which are normal to the parallel sides of horn 40 and can be straight or curved as shown. As before, the high frequency field is excited by means of a probe 43 of a coaxial input 44 placed near the throat through one of the parallel sides and the low frequency field is launched by means of a $TE_{01}$ wave propagated through a rectangular waveguide input 45 placed at the throat of the horn 40 and oriented in a manner to launch the electric field normal to the notched fins 41, 42. The operation of the device is similar to that described in connection with FIGS. 1 and 2.

Figure 4:
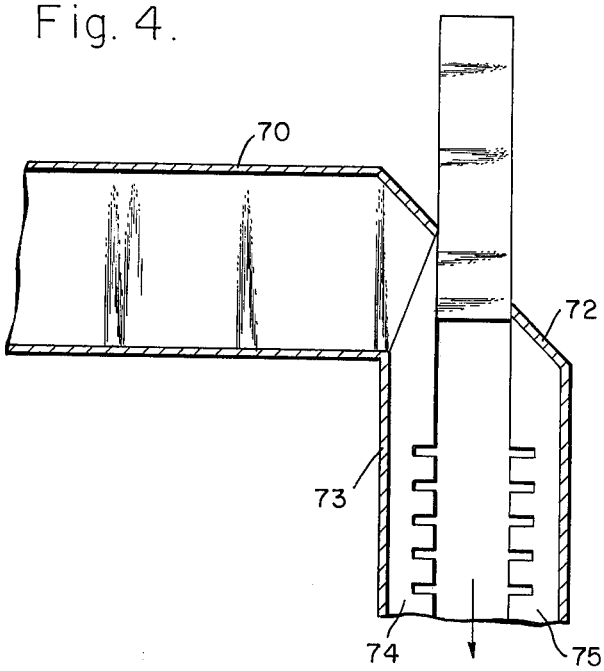
FIG. 4 illustrates a cross-sectional view of an input to a notched fin horn.
Figure 5A:
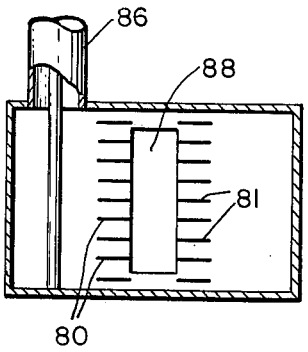
FIGS. 5*a* and 5*b* illustrate an alternative input to a notched fin horn.
Figure 5B:
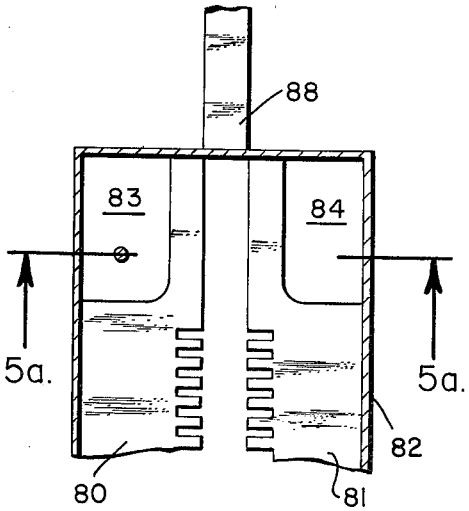
Figure 6A:
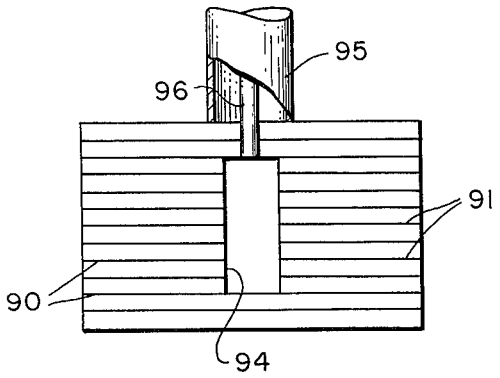
FIGS. 6*a*, 6*b* and 6*c* illustrate apparatus for feeding a notched fin horn.
Figure 6C:
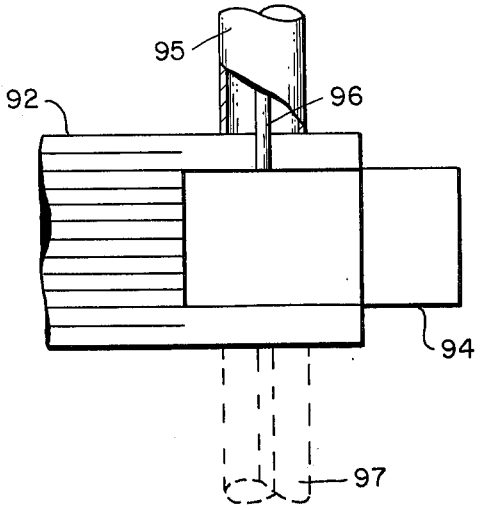
Figure 6B:
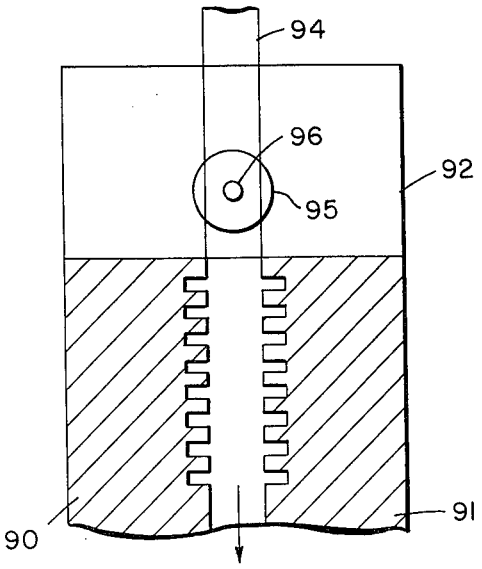

Referring to FIGS. 4, 5 and 6 there is shown several types of inputs to notched-fin horns of the type described in connection with FIGS. 1–3. In particular, FIG. 4 shows a low frequency waveguide 70 which feeds a mitred H-plane bend 72 into the throat 73 of horn 10 or 40, for example, so as to launche an electric field normal to notched fins 74, 75. A high frequency waveguide 76 is inserted through the mitre of the mitred H-plane bend 72 and is terminated at the commencement of the notched fins 74, 75 and is oriented so as to launch an electric field between the notched fins 74, 75.

FIG. 5*a* and *b* on the other hand, illustrate side and end cross-sections of a combination coax-waveguide input for a notched-fin horn of the type described in connection with FIGS. 1 and 2. In this case notched-fins 80, 81 extend to the end of a throat portion 82 with corner segments 83, 84 cut out so as to accommodate a low frequency coaxial input 86. An additional coaxial input (not shown) may be employed in the remaining corner if low frequency dual feeding is desired. A center conductor 87 of coaxial input 86 extends from the top of the bottom of throat portion 82. Lastly, a high frequency waveguide 88 is passed through the rear portion of the throat 82 between the notched-fins 80, 81 and is oriented so as to launch the high frequency electric field between the notched-fins 80 and 81 thereby to provide a high frequency input.

Referring to FIG. 6*a*, *b* and *c* there is shown end, top and side cross-sectional views, respectively, of an alternative embodiment of the notched-fin horn described in connection with FIGS. 1 and 2. In particular, notched-fins 90, 91 are disposed in pairs in throat portion 92 and are terminated short of the end thereof. A high frequency waveguide 94 is inserted through the end of throat portion 92 and extends inwards to the commencement of the notched-fins 90, 91. Waveguide 94 is oriented so as to launch the electric field of a high frequency electromagnetic wave between the notched-fins 90, 91. A coaxial input 95 is disposed on the top of the throat portion 92 opposite the void left by the termination of the notched-fins 90, 91 with a center conductor 96 extending into the throat portion 92 to the narrow wall of waveguide 94. A similar coaxial input 97 (shown in dashed lines) may be installed through the opposite wall of throat portion 92 directly opposite coaxial input 95 if dual feeding for low frequencies is desired. The coaxial input energizes an electric field that is normal to the notched-fins 90, 91.

Figure 7A:
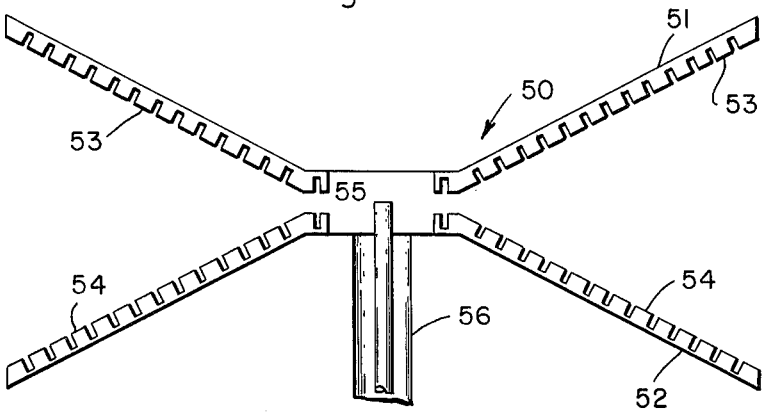
FIGS. 7*a* and 7*b* illustrate a biconical antenna using notched fins for phase and amplitude control at periphery.
Figure 7B:
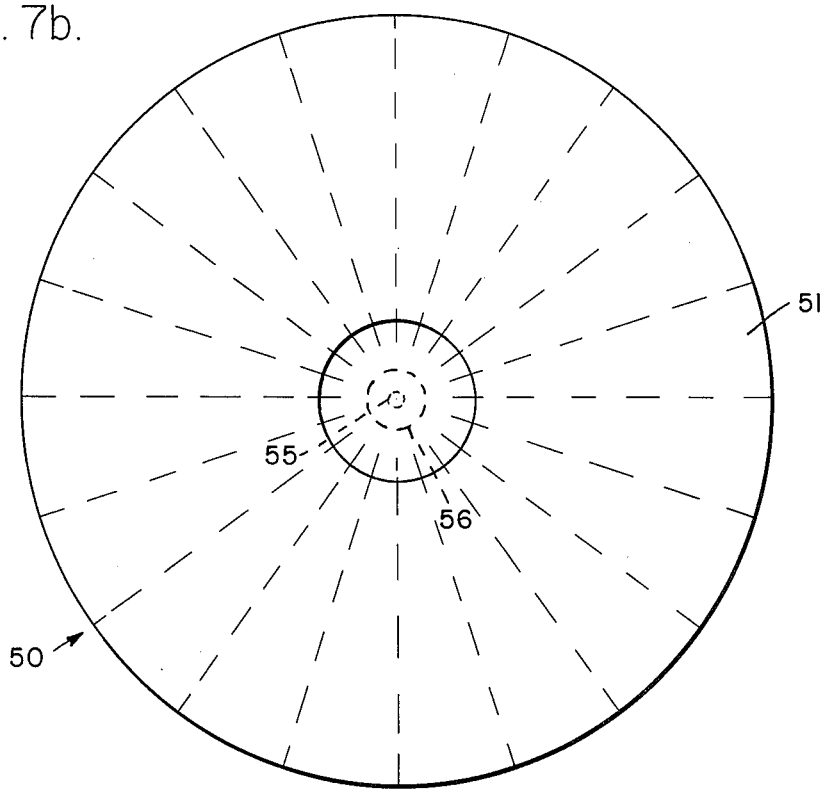

Referring to FIG. 7 there is shown a cross-sectional and plan view of a biconical antenna 50 adapted to use notched fins for phase and amplitude control at the periphery thereof. The notched fin biconical antenna 50 includes upper and lower conical sections 51, 52, respectively, having the same axis of rotation and having flat annular coextensive center portions to form a throat. Notched fins 53, 54 are disposed normal to the conical sections 51, 52 and are arranged to run radially outwards in pairs from a circular boundary disposed about the axis of rotation of the conical sections 51, 52. The antenna 50 is fed by means of a probe 55 penetrating through the center portion of conical section 52 from a coaxial input 56. A waveguide might also be used to feed the antenna 50 in lieu of the coaxial input 56. The notched fins 53, 54 function to control the phase and amplitude at the periphery of the antenna 50. In the event a circularly polarized wave is launched from the center portion of antenna 50, it will not be affected by the notched fins 53, 54.

Figure 9:
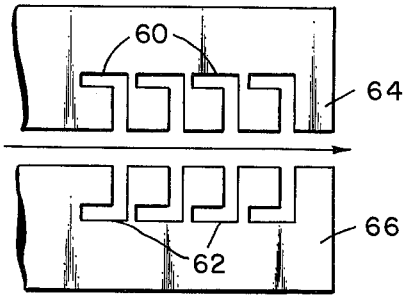
FIG. 9 illustrates notches in fins that are folded or slanted for compactness.
Figure 8:
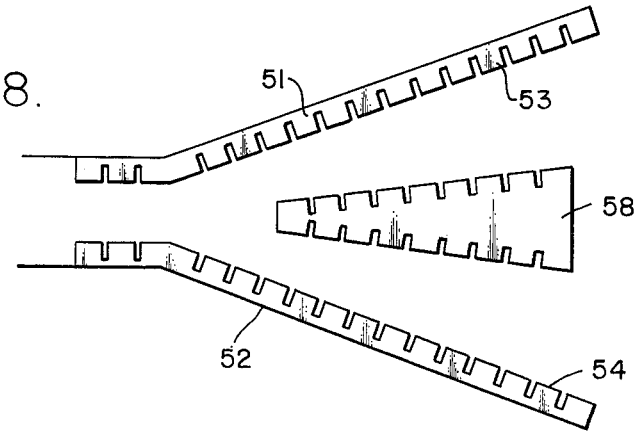
FIG. 8 illustrates the use of additional notched fins for phase control disposed in the plane of the fin.

Referring to FIG. 8, there is illustrated the use of notched fins 58 in the plane of the respective pairs of fins 53, 54 for additional phase control in the apparatus of FIG. 7. It should be noted that the notches in any of the fins may be folded or slanted for compactness. Referring to FIG. 9 there is illustrated notches 60, 62 in fins 64, 66, respectively which are folded at right angles near the center portions thereof. Inasmuch as the notch can be straight, it is evident that the "fold" need not be at right angles but can be anywhere between a straight notch and a notch folded to an acute angle. Alternatively, curved or slanted notches may be employed as may best suit the space available. The phase velocity between the notched fins 64, 66 is determined by the notch parameters such as the peripheral distance irrespective of whether the notches are folded or straight.

What is claimed is:

1. An antenna element comprising a horn-type radiating element, means for exciting said horn-type radiating element with two orthogonally polarized signals from a higher and a lower frequency band, and means for providing a plurality of conductive fin pairs on opposing inner surfaces of said horn-type radiating element in a plane parallel to that of the polarization of said signal from the higher frequency band, said conductive fin pairs having a plurality of notches disposed along the adjacent edges thereof having a nominal depth of one-quarter wavelength at the frequency of said polarized signal from said higher frequency band.

2. A dual-frequency feed horn comprising a rectangular horn having a throat extremity and an aperture, means for exciting said throat extremity of said rectangular horn with two orthogonally polarized signals from a higher and a lower frequency band, and means for providing a plurality of conductive fin pairs along opposing inner surfaces of said rectangular horn between the throat and aperture thereof, in planes parallel to that of the polarization of said signal from the higher frequency band, said conductive fin pairs each having a plurality of notches disposed along the adjacent edges thereof having a nominal depth of one-quarter wavelength at the frequency of said polarized signal from said higher frequency band.

3. An antenna element comprising a horn-type radiating element, means for exciting said horn-type radiating element with two orthogonally polarized signals from a higher and a lower frequency band, and means for providing a plurality of conductive fin pairs on opposing inner surfaces of said horn-type radiating element in a plane parallel to that of the polarization of said signal from the higher frequency band, said conductive fin pairs having a plurality of folded notches disposed along the adjacent edges thereof.

4. A dual-frequency feed horn comprising a rectangular horn having a throat extremity and an aperture, means for exciting said throat extremity of said rectangular horn with two orthogonally polarized signals from a higher and a lower frequency band, and means for providing a plurality of conductive fin pairs along opposing inner surfaces of said rectangular horn between the throat and aperture thereof, in planes parallel to that of the polarization of said signal from the higher frequency band, said conductive fin pairs each having a plurality of notches disposed along the adjacent edges thereof and additionally including notches along the edges thereof in the plane of said aperture for shaping the beam radiated from said horn.

5. The dual-frequency feed horn as defined in claim 4 wherein said means for exciting said throat extremity thereof with two orthogonally polarized signals from a higher and a lower frequency band includes a waveguide tapered into the throat of said horn for exciting said throat extremity with said one of said two orthogonally polarized signals from said lower frequency band polarized normal to said conductive fin pairs, and a coaxial input having a center probe parallel to the plane of said conductive fin pairs thereby to excite the remaining one of said two orthogonally polarized signals in said throat extremity of said feed horn.

6. The dual-frequency feed horn as defined in claim 4 wherein said means for exciting said throat extremity thereof with two orthogonally polarized signals from a higher and a lower frequency band includes a lower frequency waveguide connected through a mitred H-plane bend into said throat extremity of said horn for exciting said throat extremity with said one of said two orthogonally polarized signals from said lower frequency bend polarized normal to said conductive fin pairs and a higher frequency waveguide inserted through the mitre of said H-plane bend to the commencement of said conductive fin pairs with the broad sides thereof contacting opposite edges of said conductive fins thereby to excite the remaining one of said two orthogonally polarized signals in said throat extremity of said feed horn.

7. The dual-frequency feed horn as defined in claim 4 wherein said means for exciting said throat extremity thereof with two orthogonally polarized signals from a higher and a lower frequency band includes a waveguide for propagating signals from said higher frequency band inserted into said throat extremity to the commencement of said conductive fin pairs, the broad sides of said waveguide contacting opposite edges thereof, and means including a probe connected to the center conductor of a coaxial line for exciting a signal from said lower frequency band within said throat extremity of a polarity normal to said conductive fin pairs.

* * * * *